US009266220B2

(12) United States Patent
Sivasubramanian et al.

(10) Patent No.: US 9,266,220 B2
(45) Date of Patent: Feb. 23, 2016

(54) ABRASIVE ARTICLES AND METHOD OF FORMING SAME

(71) Applicants: Shivshankar Sivasubramanian, Lowell, MA (US); Srinivasan Ramanath, Holden, MA (US); Ramanujam Vedantham, Worcester, MA (US); Rachana Upadhyay, Shrewsbury, MA (US); Signo Reis, Marlborough, MA (US)

(72) Inventors: Shivshankar Sivasubramanian, Lowell, MA (US); Srinivasan Ramanath, Holden, MA (US); Ramanujam Vedantham, Worcester, MA (US); Rachana Upadhyay, Shrewsbury, MA (US); Signo Reis, Marlborough, MA (US)

(73) Assignees: SAINT-GOBAIN ABRASIVES, INC., Worcester, MA (US); SAINT-GOBAIN ABRASIFS, Conflans-Saint-Honorine (FR)

( * ) Notice: Subject to any disclaimer, the term of this patent is extended or adjusted under 35 U.S.C. 154(b) by 276 days.

(21) Appl. No.: 13/731,326

(22) Filed: Dec. 31, 2012

(65) Prior Publication Data

US 2014/0182214 A1 Jul. 3, 2014

Related U.S. Application Data

(60) Provisional application No. 61/582,048, filed on Dec. 30, 2011.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***B24D 3/18*** | (2006.01) |

(52) U.S. Cl.
CPC ..... *B24D 3/18* (2013.01); *B24D 18/0009* (2013.01)

(58) Field of Classification Search
USPC ..... 51/309, 293, 307
See application file for complete search history.

(56) References Cited

U.S. PATENT DOCUMENTS

| | | | |
|---|---|---|---|
| 3,422,032 | A | 1/1969 | Figiel et al. |
| 4,411,107 | A | 10/1983 | Sekiya et al. |
| 4,547,998 | A | 10/1985 | Kajiyama |
| 4,583,325 | A | 4/1986 | Tabuchi |
| 4,693,036 | A | 9/1987 | Mori |
| 4,944,773 | A | 7/1990 | Rue et al. |

(Continued)

FOREIGN PATENT DOCUMENTS

| | | | |
|---|---|---|---|
| CN | 101005925 | A | 7/2007 |
| EP | 0211247 | A2 | 2/1987 |

(Continued)

OTHER PUBLICATIONS

International Search Report for PCT Application No. PCT/US2009/002821 mailed Dec. 30, 2009.

(Continued)

*Primary Examiner* — James McDonough
(74) *Attorney, Agent, or Firm* — Abel Law Group, LLP; Joseph P. Sullivan

(57) ABSTRACT

An abrasive article including a bonded abrasive body having a bond material made of a vitrified material, abrasive particles comprising a first type of superabrasive material contained in the bond material, a porosity of at least about 50 vol % of the total volume of the bonded abrasive body, and a ΔCTE of not greater than about 5.5 ppm/° C., wherein ΔCTE is defined as a difference between a CTE of the bond material and a CTE of the abrasive particles.

20 Claims, 2 Drawing Sheets

(56) References Cited

U.S. PATENT DOCUMENTS

| | | | | |
|---|---|---|---|---|
| 4,951,427 | A | 8/1990 | St. Pierre | |
| 5,129,919 | A | 7/1992 | Kalinowski et al. | |
| 5,152,810 | A | 10/1992 | Rue et al. | |
| 5,212,120 | A | 5/1993 | Araujo et al. | |
| 5,436,063 | A | 7/1995 | Follett et al. | |
| 5,582,672 | A | 12/1996 | Follett et al. | |
| 5,738,696 | A | 4/1998 | Wu | |
| 5,738,697 | A | 4/1998 | Wu et al. | |
| 5,776,290 | A | 7/1998 | Follett et al. | |
| 5,834,109 | A | 11/1998 | Follett et al. | |
| 5,834,569 | A | 11/1998 | Ramanath et al. | |
| 5,863,308 | A | 1/1999 | Qi et al. | |
| 5,891,206 | A | 4/1999 | Ellingson | |
| 6,056,794 | A | 5/2000 | Stoetzel et al. | |
| 6,074,278 | A | 6/2000 | Wu et al. | |
| 6,093,225 | A | 7/2000 | Itoh | |
| 6,102,789 | A | 8/2000 | Ramanath et al. | |
| 6,258,136 | B1 | 7/2001 | Kinisky et al. | |
| 6,319,109 | B1 | 11/2001 | Fujii et al. | |
| 6,348,240 | B1 | 2/2002 | Calvert et al. | |
| 6,394,888 | B1 | 5/2002 | Matsumoto et al. | |
| 6,440,185 | B2 | 8/2002 | Nagata et al. | |
| 6,450,870 | B2 | 9/2002 | Ito | |
| 6,527,634 | B2 | 3/2003 | Lee et al. | |
| 6,527,854 | B1 | 3/2003 | Prelas et al. | |
| 6,562,089 | B1 | 5/2003 | Iwai et al. | |
| 6,702,867 | B2 | 3/2004 | Carman et al. | |
| 6,709,747 | B1 | 3/2004 | Gordeev et al. | |
| 6,755,729 | B2 | 6/2004 | Ramanath et al. | |
| 6,770,107 | B2 | 8/2004 | Teutsch et al. | |
| 6,805,620 | B2 | 10/2004 | Iwai et al. | |
| 6,811,469 | B2 | 11/2004 | Yamamoto et al. | |
| 6,887,287 | B2 | 5/2005 | Li et al. | |
| 6,887,288 | B2 | 5/2005 | Hokkirigawa et al. | |
| 6,913,517 | B2 * | 7/2005 | Prasad | B24D 3/32 451/41 |
| 6,915,796 | B2 | 7/2005 | Sung | |
| 7,008,672 | B2 * | 3/2006 | Gordeev | C04B 35/573 427/249.1 |
| 7,090,565 | B2 | 8/2006 | Bonner et al. | |
| 7,294,158 | B2 | 11/2007 | Welygan et al. | |
| 7,677,955 | B2 | 3/2010 | Kajiyama et al. | |
| 7,731,832 | B2 | 6/2010 | Yamaguchi | |
| 7,927,186 | B2 | 4/2011 | Ishida et al. | |
| 8,104,665 | B2 | 1/2012 | Sekiya | |
| 8,216,325 | B2 | 7/2012 | Upadhyay | |
| 8,216,326 | B2 | 7/2012 | Upadhyay et al. | |
| 8,377,159 | B2 | 2/2013 | Yoshida et al. | |
| 8,568,499 | B2 | 10/2013 | Nagata | |
| 8,802,463 | B2 | 8/2014 | Sekiya | |
| 2001/0000838 | A1 * | 5/2001 | Nagata | B24D 3/32 51/298 |
| 2002/0016139 | A1 | 2/2002 | Hirokawa et al. | |
| 2002/0090891 | A1 | 7/2002 | Adefris et al. | |
| 2002/0173259 | A1 | 11/2002 | Drury | |
| 2002/0194947 | A1 * | 12/2002 | Frobel | B60K 23/02 74/560 |
| 2003/0010780 | A1 | 1/2003 | Redzisz | |
| 2003/0097800 | A1 | 5/2003 | Ramanath et al. | |
| 2003/0114085 | A1 | 6/2003 | Choi et al. | |
| 2003/0192258 | A1 | 10/2003 | Simon | |
| 2003/0194947 | A1 * | 10/2003 | Bright | B24B 5/363 451/28 |
| 2003/0194954 | A1 | 10/2003 | Bonner et al. | |
| 2003/0205003 | A1 | 11/2003 | Carman et al. | |
| 2003/0232586 | A1 | 12/2003 | Ramanath et al. | |
| 2004/0137834 | A1 | 7/2004 | Webb et al. | |
| 2004/0166790 | A1 | 8/2004 | Balijepalli et al. | |
| 2004/0185763 | A1 | 9/2004 | Ishizaki et al. | |
| 2004/0247873 | A1 | 12/2004 | Gordeev et al. | |
| 2006/0010780 | A1 | 1/2006 | Hall et al. | |
| 2006/0046622 | A1 | 3/2006 | Prasad | |
| 2006/0135045 | A1 | 6/2006 | Bian et al. | |
| 2006/0137256 | A1 | 6/2006 | Yui et al. | |
| 2006/0211342 | A1 | 9/2006 | Bonner et al. | |
| 2007/0028525 | A1 | 2/2007 | Woo et al. | |
| 2007/0060023 | A1 | 3/2007 | Jeong | |
| 2007/0099548 | A1 | 5/2007 | Kumar et al. | |
| 2007/0261690 | A1 | 11/2007 | Jentgens | |
| 2008/0066387 | A1 | 3/2008 | Bonner et al. | |
| 2008/0085660 | A1 | 4/2008 | Orlhac | |
| 2008/0222967 | A1 | 9/2008 | Querel et al. | |
| 2009/0093198 | A1 | 4/2009 | Subramanian et al. | |
| 2009/0218276 | A1 | 9/2009 | Linford et al. | |
| 2009/0313906 | A1 | 12/2009 | Upadhyay et al. | |
| 2010/0261419 | A1 | 10/2010 | Sung | |
| 2011/0143641 | A1 * | 6/2011 | Ramanath | B24D 7/06 451/548 |

FOREIGN PATENT DOCUMENTS

| | | | |
|---|---|---|---|
| EP | 0620083 | A1 | 10/1994 |
| EP | 0963813 | A1 | 12/1999 |
| EP | 1598147 | B1 | 11/2005 |
| EP | 1598147 | A2 | 3/2008 |
| JP | H03-281174 | A | 12/1991 |
| JP | H04-256581 | A | 9/1992 |
| JP | 1996-057768 | A | 3/1996 |
| JP | 1996-257920 | A | 10/1996 |
| JP | H08-253352 | A | 10/1996 |
| JP | H08-257920 | A | 10/1996 |
| JP | 1999-188647 | A | 7/1999 |
| JP | H11-300622 | A | 11/1999 |
| JP | 2000-190232 | A | 7/2000 |
| JP | 2000-301459 | A | 10/2000 |
| JP | 2000-343438 | A | 12/2000 |
| JP | 2003-011066 | A | 1/2003 |
| JP | 2003-136410 | A | 5/2003 |
| JP | 2003-181762 | A | 7/2003 |
| JP | 2004-034173 | A | 2/2004 |
| JP | 2005-319556 | A | 11/2005 |
| JP | 2006-130635 | A | 5/2006 |
| JP | 2006-334778 | A | 12/2006 |
| JP | 2006334778 | A | 12/2006 |
| JP | 2007-196345 | A | 8/2007 |
| JP | 2007-290101 | A | 11/2007 |
| JP | 2009-061554 | A | 3/2009 |
| JP | 2011-067947 | A | 4/2011 |
| KR | 199505120 | B1 | 5/1995 |
| KR | 1103146 | B1 | 1/2012 |
| KR | 1158303 | B1 | 6/2012 |
| TW | 201036762 | A | 10/2010 |
| WO | 95/19871 | A1 | 7/1995 |
| WO | 98/04385 | A1 | 2/1998 |
| WO | 0059684 | A1 | 10/2000 |
| WO | 00/73023 | A1 | 12/2000 |
| WO | 0185394 | A1 | 11/2001 |
| WO | 03/099518 | A1 | 12/2003 |
| WO | 2004/011196 | A1 | 2/2004 |
| WO | 2008/117883 | A1 | 10/2008 |
| WO | 2009/128982 | A2 | 10/2009 |
| WO | 2010/008430 | A1 | 1/2010 |
| WO | 2011/056680 | | 5/2011 |

OTHER PUBLICATIONS

International Search Report for PCT/US2009/002839 mailed Feb. 1, 2010.

International Search Report for PCT/US2010/054347 mailed Jul. 26, 2011.

Zhou, Libo et al., "A Novel Fixed Abrasive Process: Chemo-Mechanical Grinding Technology," Int. J. Manufacturing Technology and Management, vol. 7, Nos. 5/6, 2005, Copyright 2005 Inderscience Enterprises Ltd., pp. 441-454.

Technical Search Results, 12 pages, 2009.

International Search Report for PCT/US2010/054329 mailed Jul. 27, 2011.

International Search Report for PCT/US2012/072240 mailed Apr. 25, 2013, 2 pages.

* cited by examiner

ABRASIVE ARTICLES AND METHOD OF FORMING SAME

This application claims priority to U.S. Provisional Application No. 61/582,048, filed Dec. 30, 2011, which is incorporated herein by reference in its entirety.

BACKGROUND

1. Field of the Disclosure

The following is directed to abrasive articles, and more particularly bonded abrasive articles having a particularly high amount of porosity.

2. Description of the Related Art

In the production of electronic devices, the back surface of a semiconductor wafer having a plurality of circuits such as IC's and LSI's is ground to a predetermined thickness by a grinding machine before it is divided into individual chips. To grind the back surface of the semiconductor wafer efficiently, a grinding machine equipped with a rough grinding unit and a finish grinding unit is generally used. Generally, the article utilize to conduct the rough grinding process is a bonded abrasive body or bond grindstone, which is obtained by bonding together diamond abrasive grains having a relatively large size with a vitrified bond or metal bond material. A resin bond grindstone having diamond abrasive grains of a median particle size of 2 microns or more contained in a resin bond is typically used for finish grinding operations. Smaller sizes of diamonds generally cannot be utilized in resin bonded articles.

In some cases, the content of the inorganic bonding agent is made relatively high for increasing a grade of the vitrified grindstone and also a degree of strength with which the inorganic bonding agent holds the abrasive grains together. However, such grindstones are not completely satisfactory, having reduced porosity, which can result in difficult or insufficient fracturing and removal of used abrasive grains, leading to relatively easy glazing or clogging of the surface of the vitrified grindstone, chipping of the abrasive structure, poor dressability of the grindstone, and other drawbacks.

The formation of high-porosity grindstones has been disclosed. Generally, high-porosity grindstone bodies are accomplished by the use of foaming agents during forming, which create bubbles and thus porosity in the finally-formed abrasive product.

Still, the industry continues to demand improved grindstone materials, capable of achieving improved grinding performance.

SUMMARY

According to a first aspect, a method of forming a bonded abrasive article comprises forming a green body comprising a bond material, abrasive particles comprising a superabrasive material, and converting at least a portion of the superabrasive material to a gaseous phase material and forming a bonded abrasive body without crystalline silicon carbide In a second aspect, an abrasive article comprises a bonded abrasive body including a bond material comprising a vitrified material, abrasive particles comprising a first type of superabrasive material contained in the bond material, a porosity of at least about 50 vol % of the total volume of the bonded abrasive body, and wherein the bond material and the first type of abrasive particles have a ΔCTE of not greater than about 5.5 ppm/° C., wherein ΔCTE is defined as a difference between a CTE of the bond material and a CTE of the abrasive particles.

According to a third aspect, an abrasive article comprises a bonded abrasive body including a bond material comprising a vitrified material, abrasive particles comprising, a first type of superabrasive material having a first median particle size, and a second type of superabrasive material having a second median particle size different than the first median particle. The body also including a porosity of at least about 50 vol % of the total volume of the bonded abrasive body.

In still another aspect, an abrasive article comprises a bonded abrasive body including a bond material comprising not greater than about 14 mol % sodium oxide (Na2O) for the total mols of the bond material, abrasive particles comprising a first type of superabrasive material having a first median particle size, and a second type of superabrasive material having a second median particle size different than the first median particle. The body also including a porosity of at least about 50 vol % of the total volume of the bonded abrasive body.

For another aspect, a method of forming a bonded abrasive article comprises forming a green body comprising, a bond material, abrasive particles comprising a first type of superabrasive material having a first median particle size, and a second type of superabrasive material having a second median particle size different than the first median particle, and converting at least a portion of the second type of superabrasive material to a gaseous phase material.

In still another aspect, a method of forming a bonded abrasive article comprises forming a green body comprising a bond material, abrasive particles comprising a first type of superabrasive material having a first median particle size, and a second type of superabrasive material having a second median particle size different than the first median particle size. The method further including converting at least a portion of the second type of superabrasive material to a gaseous phase material, and trapping at least a portion of the gaseous phase material within the bond material.

According to yet another aspect, a method of forming a bonded abrasive article comprises forming a green body comprising a bond material comprising an oxide, abrasive particles comprising a superabrasive material, a portion of the superabrasive material comprising diamond, and forming a bonded abrasive body from the green body including converting at least a portion of the diamond to a gaseous phase material, the gaseous phase material forming a portion of a porosity within the bonded abrasive body.

For another aspect, an abrasive article comprises a bonded abrasive body including a bond material comprising a vitrified material, abrasive particles comprising a second type of superabrasive material having a second median particle size of not greater than about 1 micron, wherein a portion of the second type of superabrasive material is oxidized, and a porosity of at least about 50 vol % of the total volume of the bonded abrasive body.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following includes a bonded abrasive article suitable for use in material removal applications. The bonded abrasive articles of the embodiments herein may be particularly suited for grinding hard materials used in fabricating sensitive electronic material, such as wafers or substrates. In particular instances, the abrasive articles may be in the form of a grindstone used for backgrinding operations of semiconducting wafer materials.

Figure 1:
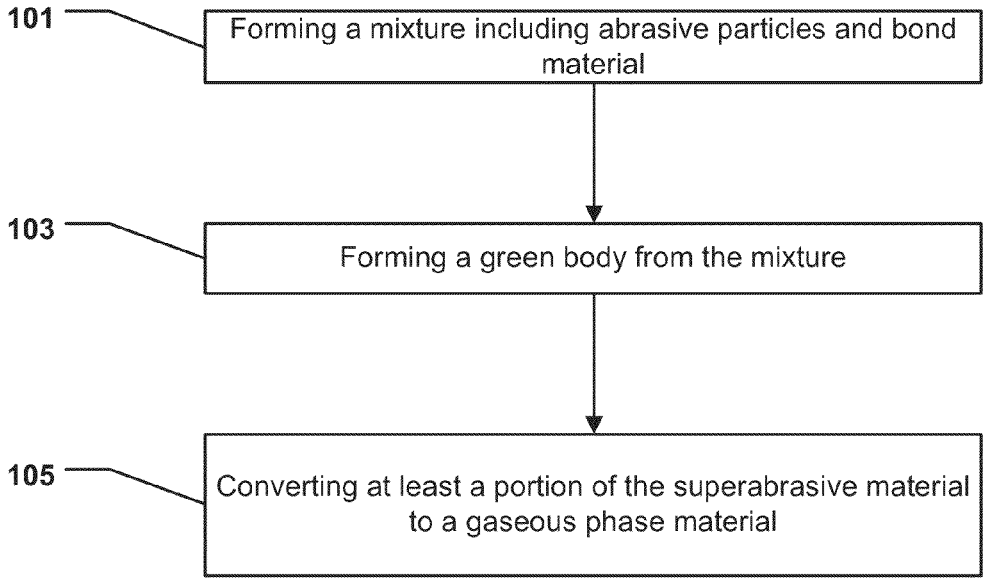
FIG. 1 includes a flow chart providing a method of forming a bonded abrasive body according to embodiment.

FIG. 1 includes a flow chart illustrating a method of forming a bonded abrasive article in accordance with embodiment. As illustrated, the process can be initiated at step 101, by forming a mixture that can include a bond material and abrasive particles. In accordance with embodiment, the bond material may be formed of an inorganic material, and more particularly a frit material that may form a vitreous phase material upon suitable heat-treatment. For certain embodiments, the bond material can include an oxide, and more particularly a combination of oxide compounds. Certain suitable bond materials can be silica-based materials, wherein a majority content of the material can be formed of silica ($SiO_2$). Forming of the mixture may include a mixing process such that the components of the mixture are uniformly dispersed within each other.

The abrasive particles of the mixture can include a superabrasive material. Suitable superabrasive materials can include cubic boron nitride (cBN), diamond and a combination thereof. In a particular embodiment, the superabrasive material can consist of essentially of diamond. The diamond may be natural or synthetic. The bonded abrasive body can be essentially free of silicon carbide.

For certain embodiments, the abrasive particles can include a first type of superabrasive material and a second type of superabrasive material. In some instances, the first type of superabrasive material and second type of superabrasive material may differ from each other based upon the median particle size of each of the types. For example, the first type of superabrasive material may have a first median particle size and the second type of superabrasive material may have a second median particle size that is different than the first median particle size. According to one embodiment, the second median particle size [PS2] can be less than the first median particle size [PS1], and more particularly, at least about 1.1 times less than the first median particle size [PS1]. Stated alternatively, the first median particle size can be at least about 1.1 times greater than the second median particle size [PS2], such that [PS1]≥[PS2]*1.1. In other instances, the second median particle size can be at least about 1.3 times less than the first median particle size, such as at least about 1.3 times less, at least about 1.5 times less, at least about 2 times less, or even at least about 2.5 times less than the first median particle size. Still, in one particular non-limiting embodiment, the second median particle size can be not greater than about 10 times less than the first median particle size. It will be appreciated that the difference between the first median particle size and the second median particle size can be within a range between any of values provided above.

For certain embodiments, the first type of superabrasive material can have a first median particle size that is at least about 1 micron. In other instances, the first median particle size can be greater, such as at least about 1.5 microns, at least about 2 microns, or even at least about 2.5 microns. Still, for at least one non-limiting embodiment, the first median particle size may be not greater about 20 microns, such as not great than about 18 microns, or even not great than about 8 microns. It will be appreciated that the first median particle size can be within a range between any of the minimum and maximum values provided above.

For one embodiment, the second type of superabrasive material can have a second median particle size that may be not greater than about 1 micron. Still, in other instances, the second median particle size may be smaller, such as not great than about 0.9 microns, not greater than about 0.8 microns, not greater than about 0.7 microns, or even not great than about 0.5. Still, in one non-limiting embodiment, the second median particle size may be at least about 0.01 microns, such as at least about 0.05 microns, at least about 0.08 microns, at least about 0.1 microns, or even at least about 0.2 microns. It will be appreciated that the second median particle size can be within a range between any of the minimum or maximum values provide above.

For certain abrasive articles, the first type of superabrasive material and second type of superabrasive material can have the same composition. For example, the first type of superabrasive material can consist essentially of diamond and a second type of superabrasive material can consist of essentially of diamond. Still, in at least one non-limiting embodiment, the second type of superabrasive material can have a different composition than the first type of superabrasive material.

The mixture can include various amounts of the first type of superabrasive material and the second type of superabrasive material. For example, in certain instances, the mixture can be formed to contain a greater content of the first type of superabrasive material than the second type of superabrasive materials. According to one embodiment, the mixture can contain at least about 1.5 times greater content (wt %) of the first type of superabrasive material than the second type of superabrasive material. In yet another instance, the mixture can include at least about 1.8 times greater, such as at least about 2 times greater, at least about 2.5 times greater, at least about 3 times greater content (wt %) of the first type of the superabrasive material than the second type of the superabrasive material.

Alternatively, the mixture may contain a greater content of the second type of superabrasive material as compared to the first type of superabrasive material. For example, the mixture may be formed to include at least about 1.5 times greater content (wt %) of the second type of superabrasive material than the first type of superabrasive material. In yet another instance, the mixture can include at least about 1.8 times greater, such as at least about 2 times greater, at least about 2.5 times greater, at least about 3 times greater content (wt %) of the second type of the superabrasive material than the first type of the superabrasive material.

Forming the mixture may include the provision of other materials in addition to the bond material on abrasive particles. For example, other additives such as foaming agents, binders, grinding agents, and the like may be added to the mixture. In certain instances, the mixture may include a minority content of binder, which may include an organic material, such as polyethylene glycol (PEG). Such binders may facilitate formation of the mixture into a green body. Furthermore, other materials may be added in minority amounts, including for example foaming agents, such as sodium silicate ($Na_2SiO_3$) or grinding aids such as cerium oxide ($CeO_2$).

After forming the mixture at step 101, the process can continue at step 103, by forming a green body from the mixture. It will be appreciated that reference to a green body includes a body that is not finally-formed and may undergo further processes, such as through a firing process, such as a bisque firing or a sintering process to densify the material. In accordance with one embodiment, one suitable process of forming a green body can include a pressing operation. Certain suitable pressing operations can include cold pressing operations, and more particularly cold isostatic pressing operations. In accordance with an embodiment, the cold pressing operation can be conducted at approximately room temperature while applying a pressure to the mixture within a range of about 0.25 tons/in$^2$ (3.44 MPa) and about 10 tons/in$^2$ (137.90 MPa).

After forming a green body at step 103, the process can continue at step 105 by converting at least a portion of the superabrasive material to a gaseous phase material. In accordance with embodiment, the process of converting at least a portion of the superabrasive material to a gaseous phase material can include a firing process. Firing may include heating the green body to a particular firing temperature and holding the green body at the firing temperature to facilitate converting at least a portion of the superabrasive material to a gaseous phase material. In one embodiment, the firing temperature can be at least about 200° C. In other embodiments, the firing temperature may be greater, such as at least about 300° C., at least about 400° C., or even at least about 500° C. Still, in one non-limiting embodiment, the firing temperature may be not greater than about 1000° C., such as not greater than about 900° C., not greater than about 850° C., or even not greater than about 800° C. It will be appreciated that the firing temperature can be within a range between any of the minimum or maximum temperatures provide above.

Furthermore, the firing process may be conducted for a particular duration at the firing temperature. For example, suitable durations can include a time of not greater than about 10 hours, such as not greater than about 8 hours, not greater than about 6 hours, or even not greater than about 5 hours. Still, the firing process may be conducted such that the duration at the firing temperature may at least about 10 minutes, such as at least about 30 minutes, at least about 1 hour, or even at least about 2 hours. It will be appreciated that the duration at the firing temperature can be within a range between any of the minimum or maximum temperatures provided above.

Furthermore, the process of converting at least a portion of the superabrasive material to a gaseous phase material can include treating the green body, particularly heat-treating the green body in a particular atmosphere. For example, the green body may undergo firing in an oxidizing atmosphere. In more particular instances, the oxidizing atmosphere may be an oxygen-rich atmosphere. In accordance with one embodiment, the oxygen-rich atmosphere can contain at least 30 vol % oxygen for the total volume of the chamber during firing. It will be appreciated that the atmosphere can be an ambient atmosphere.

In particular embodiment, the bond material can have a particular softening point temperature, which may be defined as the temperature at which the bond material has a viscosity of between about 8-9 log 10 ($\eta$, Pa·s) as measured via dilatometry. The glass transition temperature can be not greater than about 560° C. In other instances, the bond material may have a softening point temperature of not greater than about 550° C., such as not greater than about 540° C., or even not greater than about 530° C. Still, in one non-limiting embodiment, the softening point temperature of the bond material may be limited, such as that it can be at least about 200° C. or even at least about 250° C. It will be appreciated that the glass transition temperature can be within a range between any of the minimum or maximum times provide above.

During the process of converting at least a portion of the superabrasive material to a gaseous phase material, the heat treating process may be conducted at a particular temperature relative to the softening point temperature. For example, converting may be conducted such that the firing temperature can be greater than the softening point temperature of the bond material. In certain instances, the difference between the firing temperature and the softening point temperature may be set in a particular manner, such that the difference between the firing temperature and softening point temperature can be not greater than 230° C. According to another process of the embodiments herein, the different between the firing temperature and the softening point temperature of the bond can be not greater than about 220° C., not greater than about 200° C., not greater than about 195° C., not greater than about 190° C., or even not greater than about 185° C. Still, in one non-limiting embodiment, the difference between the firing temperature and the softening point temperature of the bond may be at least about 10° C., such as at least about 20° C., at least about 50° C., at least about 100° C., at least about 120° C., or even at least about 130° C. It will be appreciated that the difference between the firing temperature and the softening point temperature may be between a range between any of the minimum and maximum temperatures provided above.

For one embodiment, the process of converting at least a portion of the superabrasive material to a gaseous phase material can include converting a portion of a diamond material to a non-diamond carbon-phase material. Suitable examples of a non-diamond carbon-phase material can include graphite.

In particular instances, the process of converting can include reducing the volume percent of abrasive particles comprising the superabrasive material within the green body by changing a portion of the superabrasive material to a gaseous phase material. In more particular instances, diamond material can be oxidized thus forming a gaseous phase material comprising oxygen, carbon, and a combination thereof. For example, the diamond can be oxidized to produce a gaseous phase material of carbon dioxide, carbon monoxide, and a combination thereof.

In particular instance, the process of converting at least a portion of the superabrasive material to a gaseous phase material can include a trapping process, wherein a portion of the gaseous phase material created from the superabrasive material can be trapped within the bond material of the green body. The trapped gaseous phase material within the green body can form pores in the body. Notably, in a particular embodiment, the process of converting, and more particularly the process of trapping the gaseous phase material can be facilitated by conducting the converting process while a least a portion of the bond material is in a fluid state. Conducting the converting process while at least a portion of the bond material is in a fluid (e.g., liquid or low viscosity) state can facilitate capture of the gaseous phase material as bubbles within the fluid portion of the bond material, thus facilitating the formation of porosity within the bonded abrasive body. As such, the firing process can be conducted at a suitable temperature to convert at least a portion of the bond material into a liquid state while converting a portion of the superabrasive material to the gaseous phase material.

The process of converting can include converting a portion of the second type of superabrasive material. In particular instances, wherein the abrasive particles comprise a first type of superabrasive material and a second type of superabrasive material, the second type of superabrasive material may be preferentially oxidized over the first type of the superabrasive material. That is, for example the second type of superabrasive material having a second median particle size smaller than the first median particle size, may preferentially oxidized before the first type of superabrasive material. Thus a greater content of the second type of superabrasive material may be converted to a gaseous phase material during processing than the first type of superabrasive material.

After completing the converting process, the body may be cooled from the firing temperature to facilitate the formation of the finally-formed bonded abrasive body. It will be appreciated that further machining operations may be conducting. For example, in fact a large blank of bonded abrasive material may be formed according to the embodiment herein, which may be in the form of a brick or puck. The blank can be further processed, such as through a cutting process to extract bonded abrasive bodies of suitable dimensions.

In accordance with embodiment, the bonded abrasive body can have a significant amount of porosity. For example, the bonded abrasive body can have a porosity of at least about 50 vol % for the total volume of the bonded abrasive body including the volume of solid material and pore volume as measured by the Archimedes process. Still in other embodiments, the amount of porosity can be greater such as at least about 54 vol %, at least about 56 vol %, or even at least about 58 vol %. Still, in one non-limiting embodiment, the amount of porosity may be not greater than about 85 vol %, such as about not greater than 82 vol %, or even not greater than about 80 vol % for the total volume of the bonded abrasive body. It will be appreciated that the amount of porosity within the bonded abrasive body may be between a range between any of the minimum and maximum temperatures provided above.

Furthermore, the bonded abrasive body may have a particular content of abrasive particles. For example, the bonded abrasive body may contain at least about 5 vol %, abrasive particle for the total volume of solid components in the bonded abrasive body and excluding the volume of porosity in the body. In other instances, the amount of the abrasive particles within the bonded abrasive body can be greater, such as at least about 10 vol %, at least about 14 vol %, at least about 16 vol % or even at least about 17 vol % for the total volume of solid components of the bonded abrasive body. Still, in at least one non-limiting embodiment, the total amount of abrasives particles within the bonded abrasive material can be not greater than about 35 vol %, such as about not greater than 30 vol %, not greater than about 26 vol %, or even not greater than about 23 vol % for the total volume of solid components in the bonded abrasive body. It will be appreciated that the total amount of abrasive particles within the bonded abrasive body can be within a range between any of the minimum and maximum percentages provided above.

Furthermore, according to embodiments herein the bonded abrasive body can contain a particular amount of bond material. For example, the body can contain about 50 vol % bond material for the total volume of solid component in a bonded abrasive body excluding the content of pore volume of the body. In other instances, the bonded abrasive body can contain a higher content of bond material such as at least about 55 vol %, such as at least 60 vol %, at least about 63 vol %, at least about 66 vol % or even at least about 75 vol %. Still, according to one non-limiting embodiment, the amount of bond material within the body can be not greater than about 90 vol %, such as not greater than about 86 vol %, such as not greater than 82 vol %, not greater than about 78 vol %, or even not greater than about 74 vol %. It will be appreciated that the amount of bond material within the body can be between a range between any of the minimum and maximum percentages provided above.

The bonded abrasive body may contain a certain content of filler material. Certain suitable fillers can include compounds having elements such as sodium, cerium, and a combination thereof. In a particular embodiment, the boded abrasive body can have a content of cerium oxide ($CeO_2$) of at least about 0.4 vol % for the total volume of solid components in the bonded abrasive body excluding the volume of porosity. In other embodiments the content of cerium oxide may be greater, such that it is at least about 0.8 vol % or even at least about 1 vol %. Still, according to one non-limiting embodiment, the content of cerium oxide within the body can be limited, such that it may be not greater than about 6 vol % or not greater 4 vol %. It will be appreciated that the amount of cerium oxide within the body can be within a range within any of the minimum and maximum percentages noted above.

The bonded abrasive body may further contain specific content of sodium silicate ($Na_2SiO_3$). For example, the bonded abrasive body can contain at least about 1 vol % sodium silicate for the total volume of solid components of the bonded abrasive body. In another embodiment, the amount of sodium silicate within the bonded abrasive body may be greater, such as at least about 2 vol %, at least about 3 vol % at least about 4 vol %, or even at least about 5 vol %. Still, in a particular non-limiting embodiment, the amount of sodium silicate within the bonded abrasive body may be not greater than about 12 vol %, such as not greater than 10 vol %, or even not greater than 9 vol %. It will be appreciated that the bonded abrasive body may contain a content of sodium silicate within a range between any of the minimum and maximum percentages noted above.

Additionally, in specific instances the bonded abrasive body may be formed such that it contains limited amounts of free metal elements. For example the bottom abrasive body may contain not greater than about 1 wt % free metal elements for the total weight of the body. In other instances, the content of free metal elements may be less, such as not greater than about 0.5 wt %, not greater than about 0.1 wt %, or even not greater than about 0.05 wt %. In specific instances, the bonded abrasive body may be essentially free of free metal elements. Such compositions may facilitate use of the bonded abrasive body in grinding of sensitive electronic component.

In accordance with an embodiment, the bond material may have a specific composition facilitating the formation of the bonded abrasive body in accordance with the processes described herein. For example, the bond material can be a vitreous phase material, notably an oxide material. More particularly, the bond material may be a silica-based material that comprises at least about 50 mol % ($SiO_2$) for the total content of moles in the bond material. In other instances, the content of silica can be greater, such as at least about 52 mol %, or even least about 54 mol % silica. Still, in one non-limiting embodiment, the amount of silica within the bond material can be not greater than about 70 mol %, or even not greater than about 65 mol %. It will be appreciated that the content of silica within the bond material can be within a range between any of them minimum and maximum percentages noted above.

Additionally, the bond material may contain a specific content of alumina ($Al_2O_3$). For example, the bond material may contain not greater than about 4 mol % alumina for the total content of moles in the bond material. In other instances, the amount of alumina may be less, such as not greater than about 3 mol % for the total moles of bond material. In one non-limiting embodiment, the amount of aluminum may be at least about 0.5 mol % such as at least about 1 mol %. It will be appreciated that the amount of alumina within the bond material may be within a range within any of the minimum and maximum percentages noted above.

Furthermore, the bond material may include a specific content of boron oxide ($B_2O_3$). For example, in one embodiment the bond material may contain at least about 16 mol % boron oxide for the total content of moles in the bond material. In other instances, the amount of boron oxide may be greater, such as at least about 17 mol %, or even about 20 mol %. Still, in one non-limiting embodiment, the amount of boron oxide within the bond material may be not greater than 30 mol % or even not greater than 26 mol %. It will be appreciated that the bond material may contain a content of boron oxide within a range between any of the minimum and maximum percentages noted above.

For certain embodiments, the bond material may contain a specific amount of calcium oxide (CaO). For example, the bond material may contain not greater than about 9 mol %, such as not greater than about 8 mol %, not greater than 7 mol %, or even not greater than about 3 mol % calcium oxide for the total content of moles in the bond material. In at least one non-limiting embodiment, the amount of calcium oxide within the bond material can be at least 0.5 mol % or even 1 mol %. It will be appreciated that the amount of calcium oxide within the bond material can be within a range between any of the minimum and maximum percentages noted above.

The bond material may include a particular content of barium oxide (BaO). For example, the bond material may be formed to have at least about 0.2 mol %, such as at least about 0.5 mol %, or even at least 1 mol % barium oxide for the total content of moles in the bond material. However, in one non-limiting embodiment, the amount of barium oxide may not greater than 6 mol % or even not greater than about 4 mol %. It will be appreciated that the bond material may contain an amount of barium oxide within a range between any of the minimum and maximum percentages noted above.

According to another embodiment, the bond material may be formed to have a particular content of potassium oxide ($K_2O$). For example, the bond material can include at least 2 mol % potassium oxide or even at least about 2.5 mol % for the total content of moles in the bond material. According to one non-limiting embodiment, the amount of potassium oxide within the bond material may be not greater than about 8 mol %, such as not greater than about 6 mol %. It will be appreciated that the amount potassium oxide within the bond material may be within a range between any of the minimum and maximum percentages noted above.

Bond material may be formed to have a specific content of lithium oxide ($Li_2O$). For example, the bond material may contain at least about 0.5 mol % lithium oxide. In other instances the amount of lithium oxide may be at least about 0.8 mol % or even at least about 1 mol % for the total moles of bond materials. In one particular non-limiting example, the bond may contain no greater than about 9 mol %, such as not greater than 7 mol % lithium oxide. It will be appreciated that the amount of lithium oxide within the bond material can be within a range any of the minimum and maximum percentages noted above.

In accordance with another embodiment, the bond material may be formed to have a particular content of sodium oxide ($Na_2O$). For example, the bond material can contain not greater than about 14 mol %, such as not greater than about 12 mol %, not greater than about 10 mol %, not greater than about 8 mol % or even not greater than about 6 mol % sodium oxide for the total content of moles in the bond material. However, in another non-limiting embodiment, the bond material may contain at least 0.5 mol %, such as at least about 1 mol %, or even at least about 3 mol % sodium oxide for the total content of moles in the bond material. It will be appreciated that the bond material can contain an amount of sodium oxide within a range between any of the minimum and maximum percentages noted above.

The bond material may contain a specific content of zinc oxide (ZnO). For example, the content of zinc oxide within the bond material may be at least 0.5 mol % for the total content of moles in the bond material. In another embodiment, the bond material can contain at least about 0.8 mol % or even about 1 mol %. According to a non-limiting example, the amount of the zinc oxide within the bond material may be not greater than about 5 mol % or even not greater than about 4 mol %. It will be appreciated that the amount of zinc oxide within the bond material may be within a range between any of the minimum and maximum percentages noted above.

In specific instances, the bond material may be formed to have a particular linear coefficient of thermal expansion (CTE) to facilitate the formation of a bonded abrasive body having the features described herein. For example, the bond material can have a linear coefficient with thermal expansion as measured at 300° C. of not greater than about 9 ppm/° C. In other embodiments, the coefficient of thermal expansion of the bond material may be less, such as not greater about 8.5 ppm/° C., not greater than about 8 ppm/° C., not greater than 7.8 ppm/° C., or even not greater than about 7.6 ppm/° C. Still, in one non-limiting embodiment, the coefficient of thermal expansion of the bond material may be at least about 2 ppm/° C., such as at least about 3 ppm/° C., or even at least about 4 ppm/° C. It will be appreciated that the coefficient of thermal expansion within the bond material may be within a range between any of the minimum and maximum values noted above.

In particular instances, the bonded abrasive body can be formed such that the bond material and abrasive particles have a specific difference in coefficient of thermal expansion (ΔCTE). The specific difference in CTE may facilitate formation of the bonded abrasive body having the features describes herein. For example, the difference in CTE between the bond material and abrasive particles may be not greater than about 5.5 ppm/° C. In other instances, the difference in CTE may be not greater than about 5 ppm/° C., such as about not greater than 4.5 ppm/° C., not greater than about 4 ppm/° C., not greater than 3.8 ppm/° C., or even not greater than about 3.6 ppm/° C. However, according to one non-limiting example, the difference in CTE between the bond material and the abrasive particles may be at least about 0.2 ppm/° C. or even at least about 0.5 ppm/° C. It will be appreciated that the difference in coefficient of thermal expansion between the bond material and the abrasive particles may be within a range between any of the minimum and maximum values noted above.

Figure 2A:
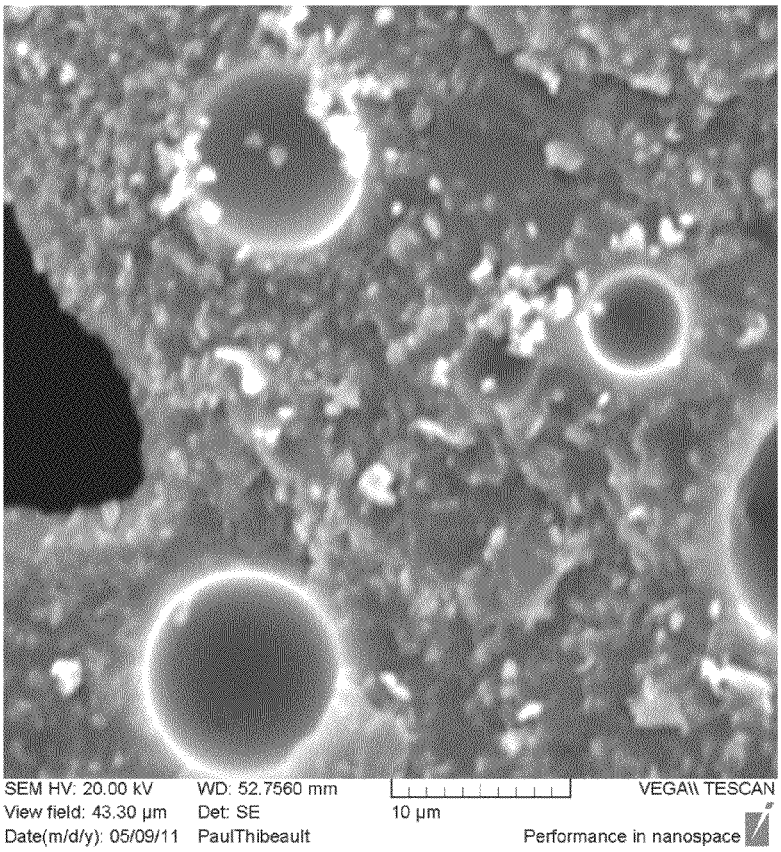
FIGS. 2A-2C include SEM images of a bonded abrasive body.
Figure 2B:
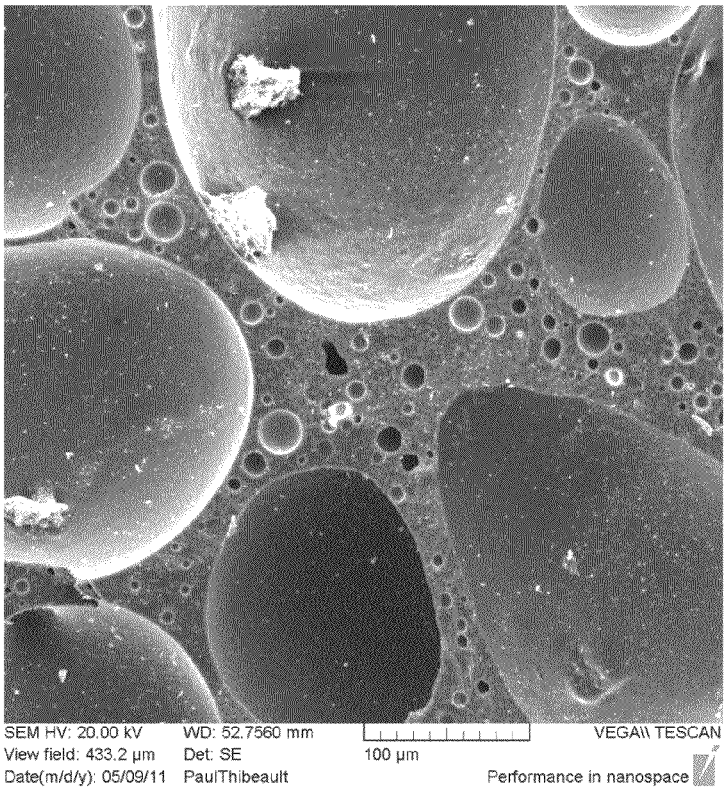
Figure 2C:
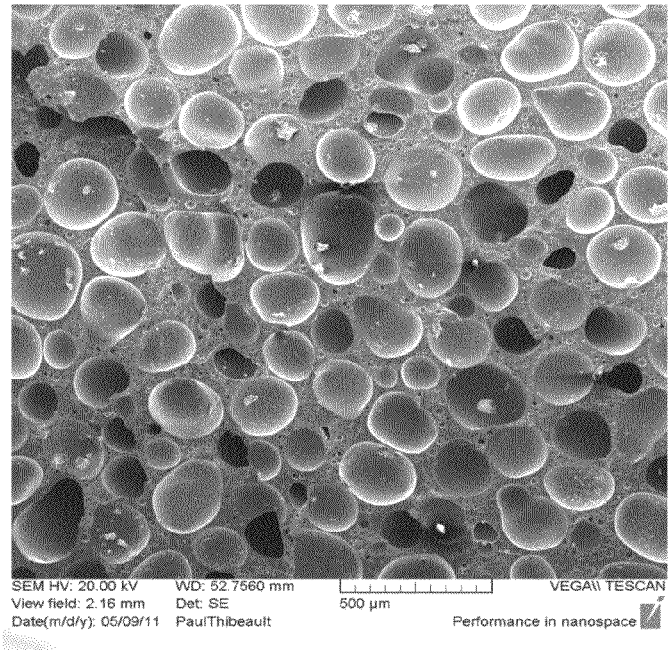

FIGS. 2A-2C include SEM photos of a bonded abrasive body. For example, FIG. 2A includes a SEM image of a surface of a bonded abrasive body. As illustrated, the bonded abrasive body can include a bond material 201 and pores 203 contained within the bond material. The pores of the bonded abrasive body can be substantially spherical, and more particularly, a majority of the pores can have an elliptical or circular shape as viewed in cross-section as provided in FIG. 2A. Moreover, a majority content of pores having smooth, arcuate surfaces as viewed in cross-section.

FIG. 2B includes a SEM image of a portion bonded abrasive body. As provided in the image of FIG. 2B, the bonded abrasive body can have a variety of various pore sizes including large pores 205 separated by bond post 207 extending between the large pores 205. Furthermore, the bonded abrasive body can include smaller pores 209 disposed in the bond material, in particularly the bond post between the large pores 205. The bonded abrasive body can have a multimodal pore size distribution. For example, the body can have a bimodal pore size distribution comprising a non-Gaussian distribution of pore sizes, such that a plot of average pore size versus frequency demonstrates a first mode defining large pores 205 having an average pore size greater than a second mode defining fine pores 209 having an average pore size less than the average pore size of the large pores 205. As illustrated, the fine pores 209 may have an average pore size that is at least 2 times smaller than the average pore size of the large pore 205.

FIG. 2C includes a SEM image of a portion of a bonded abrasive body. FIG. 2C further illustrates the distinction between the large pores 205 and the small pores 209 making up the bonded abrasive body. Furthermore, FIG. 2C illustrates the general morphology of the large pores 205, notably each of the large pores having a generally spherical three dimensional shape, and a circular or elliptical two dimensional shape as viewed in cross-section.

With regard to those embodiments incorporating a second type of superabrasive material that may be oxidized during a process of converting, such oxidation may create a non-diamond carbon-phase material, such as graphite. In particular instances, the bonded abrasive body may contain a specific content of the non-diamond carbon-phase material that can be contained in the bond material. Additionally or alternatively, the non-diamond carbon-phase material may be disposed at an exterior surface of at least a portion of the second type of superabrasive material.

In certain instances, the bonded abrasive body of the embodiment herein, can include pores that may contain some of the gaseous phase material formed during the process of converting. As such, the pores within the bonded abrasive body may contain one or more compositions comprising carbon, oxygen, and a combination thereof. In fact, in one particular embodiment, a portion of the pores of the bonded abrasive body may contain a gaseous phase material of carbon dioxide, carbon monoxide, or a combination thereof.

Embodiments of a method of forming a bonded abrasive article may comprise forming a green body comprising a bond material, abrasive particles comprising a superabrasive material, and converting at least a portion of the superabrasive material to a gaseous phase material and forming a bonded abrasive body without crystalline silicon carbide.

Embodiments of the superabrasive material may comprise diamond. For example, the superabrasive material can be diamond, or the superabrasive material may consist essentially of diamond. Embodiments of the superabrasive material may not include silicon carbide, or be essentially or substantially free of crystalline silicon carbide. The superabrasive material may contain diamond and only an amorphous (i.e., non-crystalline) form of silicon carbide.

Other embodiments of an abrasive article may comprise a bonded abrasive body without crystalline silicon carbide and include a bond material comprising a vitrified material, and abrasive particles comprising: a first type of superabrasive material having a first median particle size; a second type of superabrasive material having a second median particle size different than the first median particle; and a porosity of at least about 50 vol % of the total volume of the bonded abrasive body.

Some embodiments of a method of forming a bonded abrasive article may comprise forming a green body comprising a bond material and abrasive particles comprising: a first type of superabrasive material having a first median particle size; a second type of superabrasive material having a second median particle size different than the first median particle; and converting at least a portion of the second type of superabrasive material to a gaseous phase material without forming crystalline silicon carbide.

In other examples, embodiments of a method of forming a bonded abrasive article may comprise forming a green body comprising a bond material; abrasive particles comprising: a first type of superabrasive material having a first median particle size; a second type of superabrasive material having a second median particle size different than the first median particle size; converting at least a portion of the second type of superabrasive material to a gaseous phase material without forming (or be substantially or essentially free of) crystalline silicon carbide; and trapping at least a portion of the gaseous phase material within the bond material.

EXAMPLES

Example 1

A sample is made according to the embodiments herein by mixing 25 wt % diamond particles with a median particle size of 0.5-1 microns with 75 wt % of a frit material having the composition provided in Table 1. The mixture is suitably mixed and sieved through a 165 mesh screen. 16 wt % binder of a 97% solution of polyethylene glycol (PEG). The mixture is blended again and sieved through a 20 mesh. The mixture is dried for approximately 16 hours and then cold pressed at 1 ton/square inch for 10 seconds at room temperature to form a green body. The green body is then fired through a firing cycle including heating at 550° C. for 1 hour and then 690° C. for approximately 4 hours to complete a converting process and form a bonded abrasive blank. Bonded abrasive bodies are then extracted from the bonded abrasive blank via a water jet cutting operation.

The bonded abrasive body of sample S1 has about 72 vol % bond, 19 vol % abrasive particles, 2 vol % of $CeO_2$, and 7 vol % $Na_2SiO_3$ for the total volume of the solid components. The bonded abrasive body also includes approximately 70-85 vol % porosity for the total volume of the body.

TABLE 1

Bond Composition of Sample 1

| Material | Mol % |
|---|---|
| Al2O3 | 1.69 |
| B2O3 | 20.57 |
| BaO | 1.17 |
| CaO | 1.94 |
| Fe2O3 | 0.01 |
| K2O | 3.6 |
| Li2O | 5.56 |
| MgO | 0.05 |
| Na2O | 4.85 |
| SiO2 | 58.31 |
| ZnO | 2.2 |
| ZrO2 | 0.05 |

CS1 is a comparative grindstone utilized in backgrinding operations on semiconductor wafers, commercially available as from Saint-Gobain Abrasives, Inc. The CS1 body includes 19 vol % diamond having a median particle size of 0.5-1 microns, 78 vol % bond material, 2 vol % CeO2, 1 vol % SiC, 0 vol % $Na_2SiO_3$, and about 72-74 vol % porosity.

CS2 is a comparative grindstone utilized in backgrinding operations on semiconductor wafers, commercially available as Poligrind from Disco Corporation. The CS2 body includes 25 wt % diamond having a median particle size of 2 microns, 25 wt % bond material, 25 wt % $Na_2SiO_3$, 25 wt % Polystyrene particles, and 75-90 vol % porosity. The bond material of sample CS2 was measured via ICP and is provided in Table 2 below.

TABLE 2

| Material | Mol % |
|---|---|
| Al2O3 | 4.87 |
| B2O3 | 19.79 |
| BaO | 0 |
| CaO | 9.5 |
| Fe2O3 | 0 |
| K2O | 1.92 |
| Li2O | 0 |
| MgO | 0.31 |
| Na2O | 15.77 |
| SiO2 | 47.63 |
| ZnO | 0 |
| ZrO2 | 0 |

Samples S1 and CS2 are used in a backgrinding process to measure the wear. The backgrinding operation is conducted using a load of approximately 45N, grinding time of 15 sec, a spindle speed of 150 rpm, on a workpiece of 100 grit sandpaper. The wear of sample S1 is approximately equivalent to the wear of sample CS2. Without wishing to be tied to a particular theory, it is thought that the use of particular combination of components facilitates improved wear of the bonded abrasive body over state of the art grindstone articles.

Example 2

Sample CS3 is a comparative grindstone utilized in backgrinding operations on semiconductor wafers, commercially available as from Saint-Gobain Abrasives, Inc., as Supernano. The CS3 body includes 19 vol % diamond having a median particle size of 0.72 microns (d50) and 0.15 microns (SD), 78 vol % bond material, 2 vol % CeO2, 1 vol % SiC, and about 68-72 vol % porosity.

During its manufacture, CS3 contained about 1 wt % to 2 wt % SiC that was converted to a gaseous phase. However, CS3 retains a residual amount of crystalline silicon carbide that remains in the final product. In contrast, sample S1 had no detectable crystalline silicon carbide.

The foregoing embodiments are directed to abrasive products, and particularly bonded abrasive products, which represent a departure from the state-of-the-art. The bonded abrasive products of the embodiments herein utilize a combination of features that facilitate improved grinding performance. As described in the present application, the bonded abrasive bodies of the embodiments herein utilize a particular amount and type of abrasive particles, particular amount and type of bond material, a particular amount and type of porosity, and other additives. Moreover, it was discovered that the bonded abrasive articles of the present embodiments are capable of having marked differences in certain mechanical characteristics versus some state-of-the-art conventional articles, including for example wear.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:
a bonded abrasive body including:
a bond material comprising a vitrified material;
abrasive particles comprising a first type of superabrasive material having a first median particle size; and
a second type of superabrasive material having a second median particle size that is less than the first median particle size;
a porosity of at least about 70 vol % and not greater than about 85 vol % of the total volume of the bondedabrasive body, and wherein the bonded abrasive body includes a first content of the first type of superabrasive material and a second content of the second type of superabrasive material, wherein the first content is greater than the second content.

2. The abrasive article of claim 1, wherein the bond material comprises not greater than about 14 mol % sodium oxide ($Na_2O$).

3. The abrasive article of claim 1, wherein the abrasive particles comprise diamond.

4. The abrasive article of claim 1, wherein the second median particle size is at least 1.1 times less than the first median particle size and not greater than 10 times less than the first median particle size.

5. The abrasive article of claim 1, wherein the first type of superabrasive material comprises a median particle size of at least about 1 micron and not greater than about 20 microns.

6. The abrasive article of claim 1, wherein the second type of superabrasive material comprises a median particle size of at least about 0.01 microns and not greater than about 0.9 microns.

7. The abrasive article of claim 1, wherein the first content (wt %) is at least about 1.5 times greater than the second content (wt %).

8. The abrasive article of claim 1, wherein the bonded abrasive body comprises at least about 50 vol % and not greater than about 90 vol % bond material for the total volume of solid components in the bonded abrasive body.

9. An abrasive article comprising:
a bonded abrasive body including:
a bond material comprising a vitrified material;
abrasive particles comprising a first type of superabrasive material having a first median particle size; and
a second type of superabrasive material having a second median particle size that is less than the first median particle size;
a porosity of at least about 50 vol % of the total volume of the bonded abrasive body, and wherein the bonded abrasive body includes a first content of the first type of superabrasive material and a second content of the second type of superabrasive material, wherein the first content is greater than the second content, and wherein the bonded abrasive body comprises at least about 66 vol % and not greater than about 78 vol % bond material for the total volume of solid components in the bonded abrasive body.

10. The abrasive article of claim 1, wherein the bonded abrasive body comprises at least about 5 vol % and not greater than about 35 vol % abrasive particles of the total volume of solid components in the bonded abrasive body.

11. The abrasive article of claim 1, wherein the bonded abrasive body comprises at least about 17 vol % and not greater than about 26 vol % abrasive particles of the total volume of solid components in the bonded abrasive body.

12. The abrasive article of claim 1, wherein the abrasive particles consist essentially of diamond.

13. The abrasive article of claim 1, wherein the bonded abrasive body is essentially free of silicon carbide (SiC).

14. An abrasive article comprising:

a bonded abrasive body including:

a bond material comprising a vitrified material;

abrasive particles comprising a first type of superabrasive material having a first median particle size; and a second type of superabrasive material having a second median particle size that is less than the first median particle size;

a porosity of at least about 50 vol % of the total volume of the bonded abrasive body, and wherein the bonded abrasive body includes a first content of the first type of superabrasive material and a second content of the second type of superabrasive material, wherein the first content is greater than the second content, and wherein the bonded abrasive body comprises graphite.

15. The abrasive article of claim 1, wherein the bond material comprises a softening point temperature of at least about 200° C. and not greater than about 560° C.

16. The abrasive article of claim 1, wherein the bonded abrasive body comprises a bonded abrasive disk configured for grinding of semiconductor wafers.

17. The abrasive article of claim 2 wherein the bond material comprises at least about 1 mol % and not greater than about 9 mol % lithium oxide ($Li_2O$).

18. The abrasive article of claim 17, wherein the bond material comprises:

not greater than about 4 mol % alumina ($Al_2O_3$);

at least about 20 mol % boron oxide ($B_2O_3$); and at least about 50 mol % silica ($SiO_2$); and wherein the bonded abrasive body comprises:

at least about 1 vol % and not greater than about 12 vol % sodium silicate ($Na_2SiO_3$); and at least about 66 vol % and not greater than about 78 vol % bond material for the total volume of solid components in the bonded abrasive body.

19. The abrasive article of claim 9, wherein the bond material comprises:

not greater than about 14 mol % sodium oxide ($Na_2O$);

at least about 1 mol % and not greater than about 9 mol % lithium oxide ($Li_2O$);

not greater than about 4 mol % alumina ($Al_2O_3$);

at least about 20 mol % boron oxide ($B_2O_3$); and at least about 50 mol % silica ($SiO_2$); and wherein the bonded abrasive body comprises:

at least about 1 vol % and not greater than about 12 vol % sodium silicate ($Na_2SiO_3$);

at least about 66 vol % and not greater than about 78 vol % bond material for the total volume of solid components in the bonded abrasive body; and at least about 70 vol % and not greater than about 85 vol % porosity for the total volume of the bonded abrasive body.

20. The abrasive article of claim 14, wherein the bond material comprises:

not greater than about 14 mol % sodium oxide ($Na_2O$);

at least about 1 mol % and not greater than about 9 mol % lithium oxide ($Li_2O$);

not greater than about 4 mol % alumina ($Al_2O_3$);

at least about 20 mol % boron oxide ($B_2O_3$); and at least about 50 mol % silica ($SiO_2$); and wherein the bonded abrasive body comprises:

at least about 1 vol % and not greater than about 12 vol % sodium silicate ($Na_2SiO_3$);

at least about 66 vol % and not greater than about 78 vol % bond material for the total volume of solid components in the bonded abrasive body; and at least about 70 vol % and not greater than about 85 vol % porosity for the total volume of the bonded abrasive body.

* * * * *